US006612413B2

(12) United States Patent
Kuwayama

(10) Patent No.: US 6,612,413 B2
(45) Date of Patent: Sep. 2, 2003

(54) LUGGAGE

(75) Inventor: Osamu Kuwayama, Aichi-ken (JP)

(73) Assignee: Sunco Luggage Co., Ltd., Aichi-ken (JP)

( * ) Notice: Subject to any disclaimer, the term of this patent is extended or adjusted under 35 U.S.C. 154(b) by 0 days.

(21) Appl. No.: 09/933,444

(22) Filed: Aug. 21, 2001

(65) Prior Publication Data

US 2003/0038010 A1 Feb. 27, 2003

(51) Int. Cl.[7] ..... A45C 13/00; A45C 13/04; A45C 13/36

(52) U.S. Cl. ..... 190/127; 190/24; 190/122

(58) Field of Search ..... 190/24, 122, 127, 190/125

(56) References Cited

U.S. PATENT DOCUMENTS 6,109,404 A * 8/2000 Bishop ..... 190/127 X
6,119,835 A * 9/2000 Lin ..... 190/127
6,148,973 A * 11/2000 Chang ..... 190/127
6,220,412 B1 * 4/2001 Lin ..... 190/127
6,260,680 B1 * 7/2001 Lin ..... 190/127 X
6,283,261 B1 * 9/2001 Sher ..... 190/127 X

FOREIGN PATENT DOCUMENTS

GB 619686 * 3/1949 ..... 190/127

* cited by examiner

*Primary Examiner*—Sue A. Weaver
(74) *Attorney, Agent, or Firm*—Harrison & Egbert

(57) ABSTRACT

A luggage includes a frame which is formed of bottom plate, top side plate and back plate. The top side plate and left and right side plates and top plate are joined together. The lower edges of the top side plate and the back plate are fastened to the side edge of the bottom plate. The top edge of the back plate is fastened to the top plate. The back plate is provided on the top with a stacking plate to facilitate the stacking of the top plate. The junctures of the side edges of the bottom plate, the side plates and the top plate are arcuate in shape. The juncture of the back plate and the stacking plate is arcuate in shape. The frame is resistant to deformation.

2 Claims, 9 Drawing Sheets

LUGGAGE

BACKGROUND OF THE INVENTION

1. Field of the Invention

The present invention relates generally to luggage, and more particularly to luggage having a fabric shell which is provided with a platelike frame for reinforcing the fabric shell, without the use of the reinforcing ring, thereby enhancing the productivity of the luggage, reducing the weight of the luggage, and increasing the degree of the design freedom of the luggage.

2. Description of Related Art

As shown in FIGS. 3–9, prior art luggage 50 has a main body 51 formed of the lining cloth of the outer cloth by sewing.

The front side of the main body 51 is in the open state and is covered by a cover piece 52 which is made of cloth and is provided in the four fringes thereof with zippers 53, 54 for fastening and unfastening the adjoining fringes.

As shown in FIG. 4 a platelike frame 55 is disposed in the gap located between the outer cloth and the lining cloth for maintaining the shape of the luggage 50 and for reinforcing.

In order to facilitate the inserting of the frame 55 into the gap, the frame 55 is divided into a frame main body 55A, a left side plate 55B, and a right side plate 55B. The main body is integrally made with the back plate, the bottom plate, and the top plate.

As shown in FIG. 5, a reinforcing ring 56 is fastened by sewing with the four edges of the left and the right side walls of the luggage main body 51. The reinforcing ring 56 is made of a metal wire and is rectangular in shape.

As shown in FIG. 6, the luggage 50 is provided with a handle 57 for use in carrying the luggage, and a caster 58.

The structures of a conventional luggage 60 are shown in FIGS. 7–9. The luggage 60 is basically similar in construction to the luggage 50 such that the main body 61 of the luggage 60 is the same as the main body 51 of the luggage 50.

As shown in FIG. 7, the luggage 60 has a reinforcing frame 62, which is completely similar in pattern to the frame 55.

The frame main body 62A is joined together with the top plate, left side plate and right side plate. The lower ends of the two side plates and the two side edges of the bottom plate 62B are fastened by screws.

The inner side of the frame main body 62A is fixed reinforcing plate 63.

The back plate 62C and the frame main body 62A are not made integrally and are made separately.

The frame main body 62A is susceptible to deformation by an external force. Each edge of the front side and the back side of the luggage main body 61 is provided with a reinforcing ring 64 fastened therewith by sewing, as shown in FIG. 8. The reinforcing ring 64 is made of a metal wire and is rectangular in shape.

The conventional luggage 50 described above has shortcomings, which are described hereinafter.

In the first place, the frame main body 55A and two side plates 55B are not connected together, thereby causing the main body 55 to be susceptible to deformation by an external force.

The above shortcoming may be overcome by the reinforcing ring 56 which is fastened to the luggage main body 51 by sewing. However, it is very inconvenient and time-consuming to fasten the reinforcing ring 56 to the luggage main body 51 by sewing.

The reinforcing ring 56 is made of metal and is responsible for giving an added weight to the luggage.

The frame 55 is divided into three parts, which are then inserted into the receiving space between the lining cloth and the outer cloth as integral parts of the luggage main body 51. It is conceivably time-consuming and costly to insert the three parts of the frame 55 in the receiving spaces between the lining cloth and the outer cloth.

As shown in FIG. 6*b*, the four arcuate corners of the luggage are visible to a person who looks at the luggage from the side of the luggage, after the frame 55 has a three-dimensional shape. However, the four arcuate comers are not visible to the person who looks at the front side of the luggage.

Another conventional luggage 60 has several drawbacks which are described hereinafter.

The frame main body 62A and the back plate 62C are not connected. As a result, the main body 62 is apt to deform upon being exerted on by a horizontally-oriented external force.

The luggage 60 shares some of the shortcomings of the conventional luggage 50 described above.

The reinforcing plate 63 is rigid and heavy, so as to reinforce the structure of the frame 62. The reinforcing plate 63 gives an added weight to the luggage 60.

After the frame 62 has become a three-dimensional structure, the four arcuate corners of the luggage are visible to a person who looks at the front side of the luggage, as illustrated in FIG. 9*a*. However, the arcuate comers of the luggage are not visible to the person who looks at the side of the luggage, as illustrated in FIG. 9*b*.

The quality of the design of the luggage plays an iml role in the marketability of the luggage.

BRIEF SUMMARY OF THE INVENTION

The primary objective of the present invention is to provide a novel luggage which comprises a frame resistant to deformation even without the help of the reinforcing ring. In addition, the frame of the present invention is designed in such a pattern that the productivity of the frame is raised, and that the degree of design freedom is enhanced, thereby enabling the luggage to have an arcuate profile.

The luggage of the present invention is characterized by the frame, which is disposed between the outer cloth and the lining cloth of the luggage and is formed of a platelike material. The frame is intended to hold up the shape of the luggage and to reinforce the luggage.

The frame of the present invention is formed of a bottom plate, a top plate, and a back plate. The top plate and the left and the right plates are connected. The lower edges of the top plate and the back plate are fastened to the bottom plate. The upper edge of the back plate is fastened to the top plate. The upper end of the back plate is provided with a laminated plate, which is joined with the top plate.

The four side edges of the bottom plate, the juncture of the side plate and the top plate, and the juncture of the back plate and the laminated plate are provided with a curved portion of a radian.

In addition, the front edge of the frame is also provided with a curved portion of a radian.

The objective, features and functions of the present invention will be more readily understood upon a thoughtful deliberation of the following detailed description of a preferred embodiment of the present invention with reference to the accompanying drawings.

DETAILED DESCRIPTION OF THE INVENTION

Figure 1:
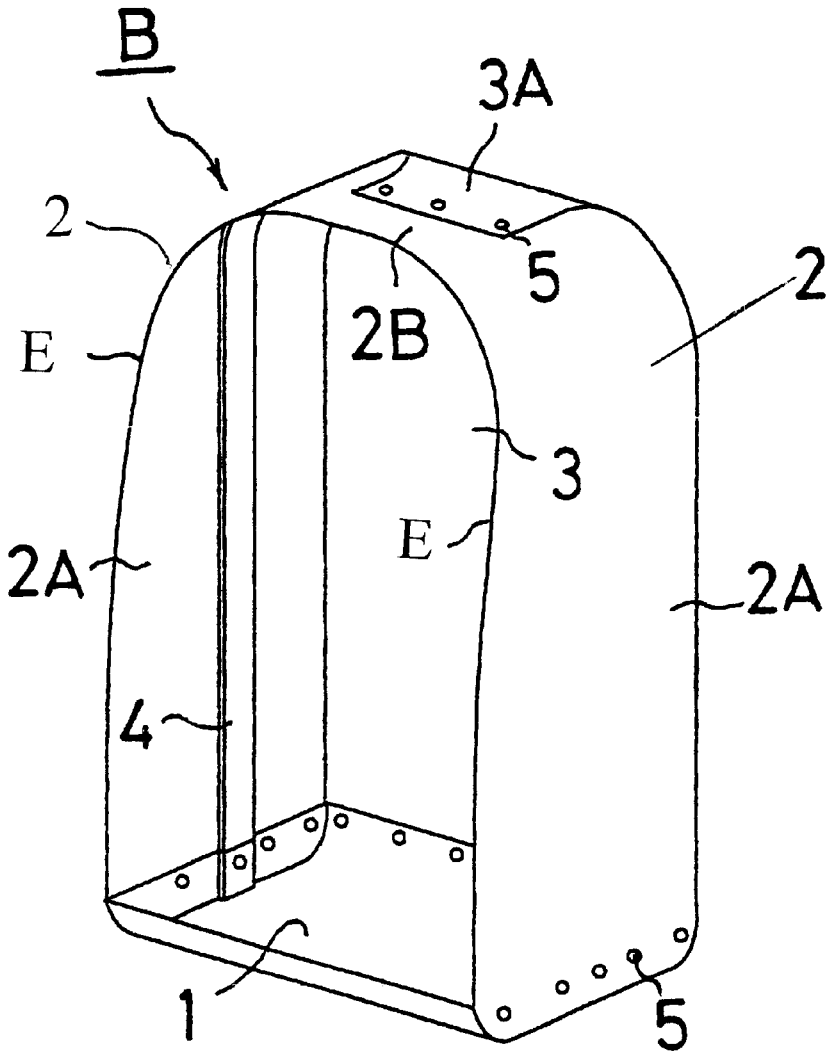
FIG. 1 shows a perspective view a frame of the preferred embodiment of the present invention.
Figure 2:
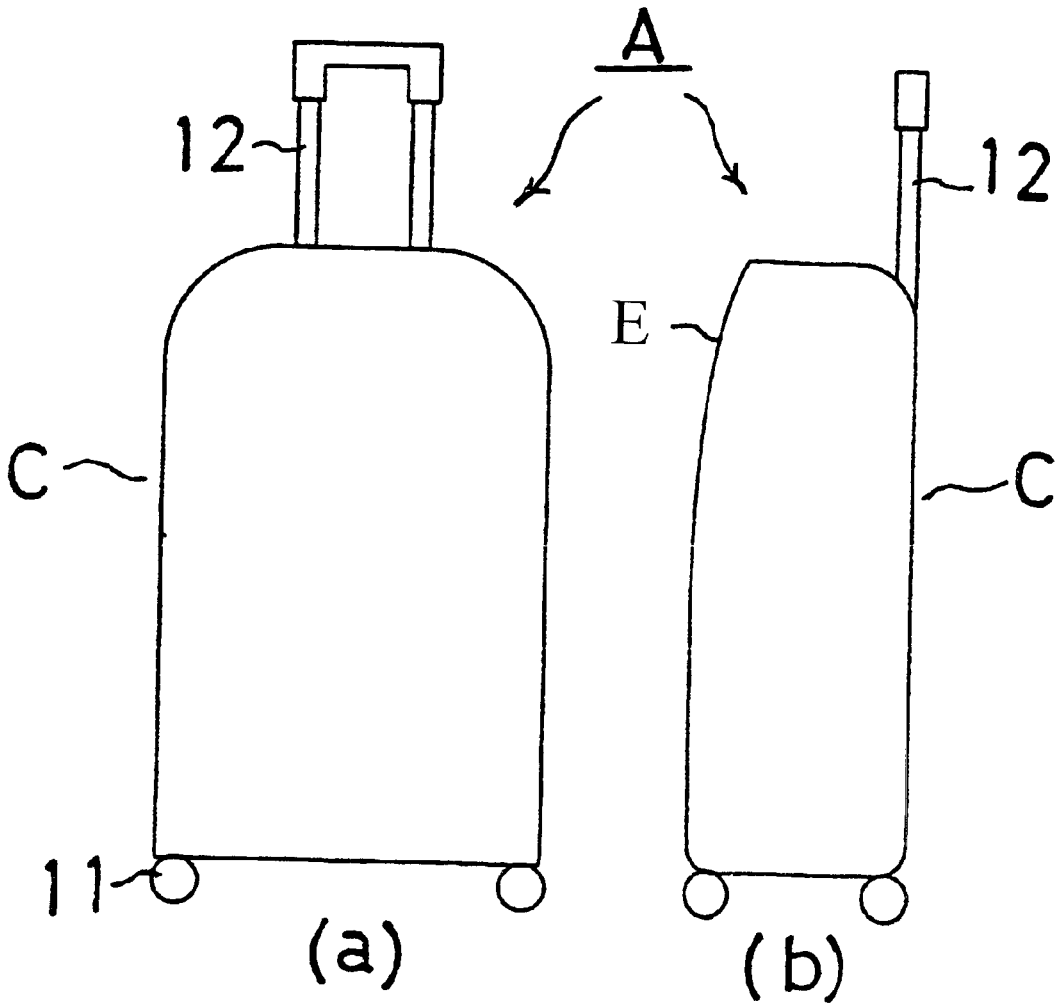
FIGS. 2*a* and *b* shows a front view and a side view of a luggage which is provided with the frame of the present invention as shown in FIG. 1.
Figure 3:
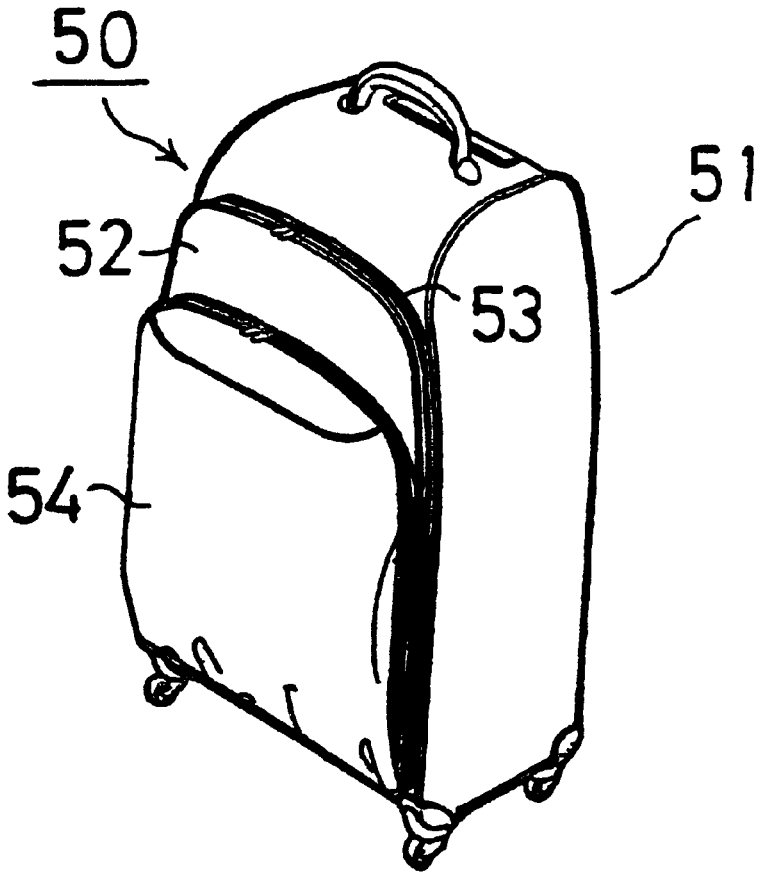
FIG.3 PRIOR ART
FIG. 3 shows a perspective view of a prior art luggage.
Figure 4:
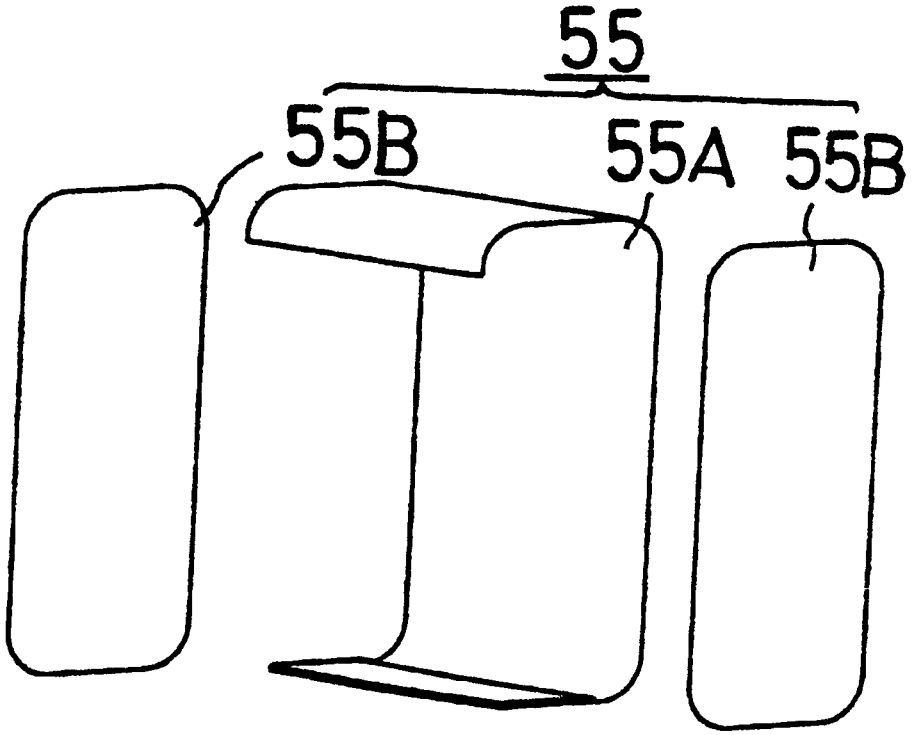
FIG. 4 PRIOR ART
FIG. 4 shows a perspective view of a frame of the prior art luggage as shown in FIG. 3.
Figure 5:
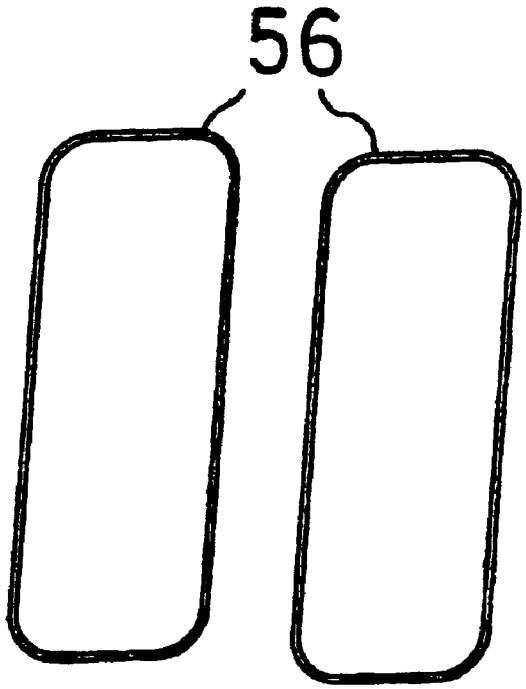
FIG.5 PRIOR ART
FIG. 5 shows a perspective view of a reinforcing ring of the prior art luggage as shown in FIG. 3.
Figure 6:
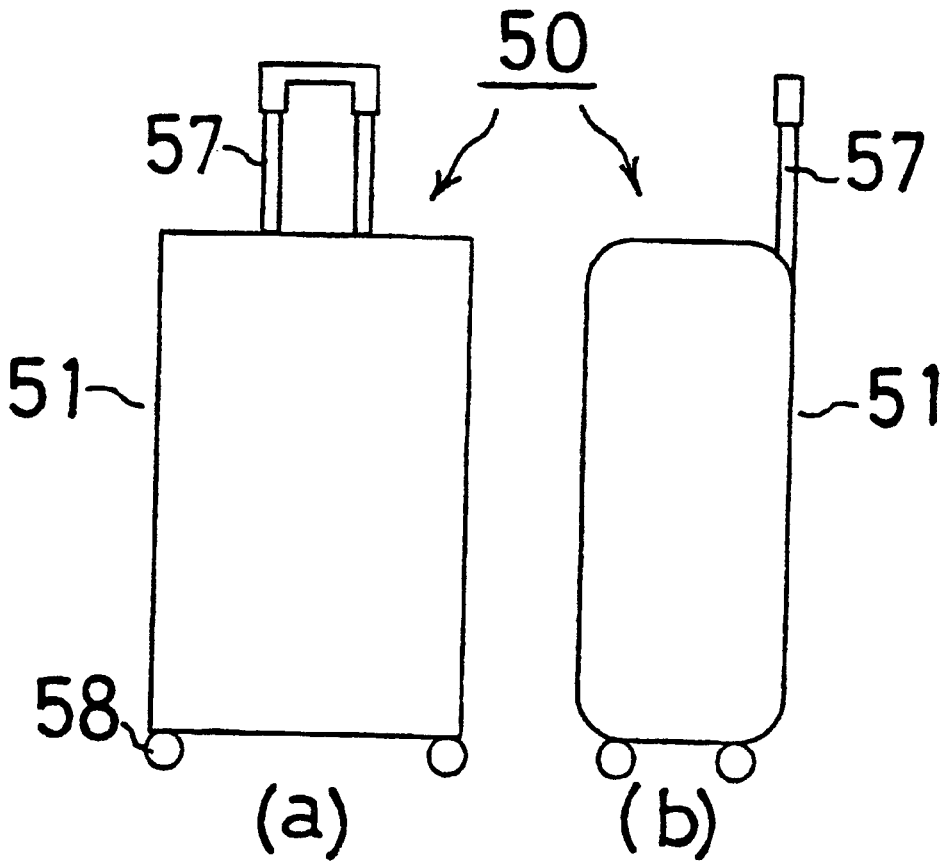
FIG.6 PRIOR ART
FIGS. 6*a* and *b* shows a front view and a side view of the luggage as shown in FIG. 3.
Figure 7:
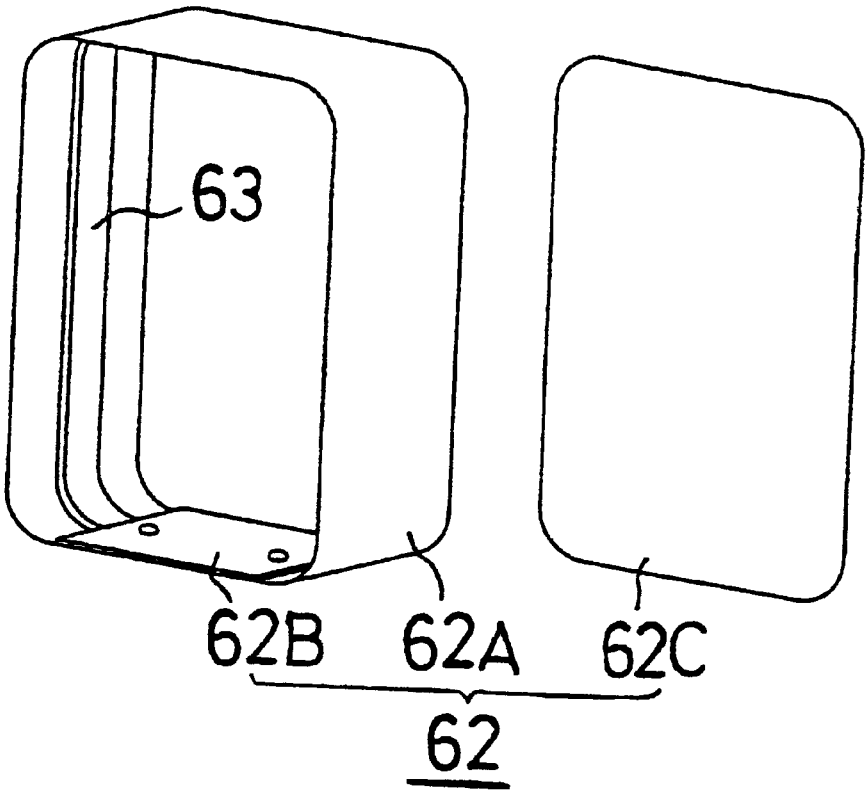
FIG. 7 PRIOR ART
FIG. 7 shows a perspective view of another prior art lug frame.
Figure 8:
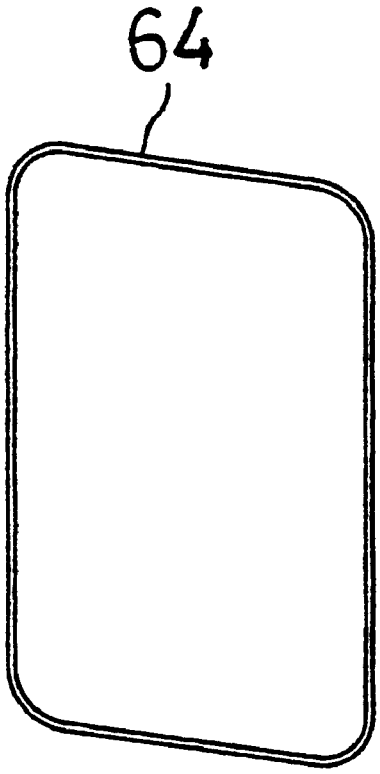
FIG.8 PRIOR ART
FIG. 8 shows a perspective view of a reinforcing ring of the prior art luggage as shown in FIG. 7.
Figure 9:
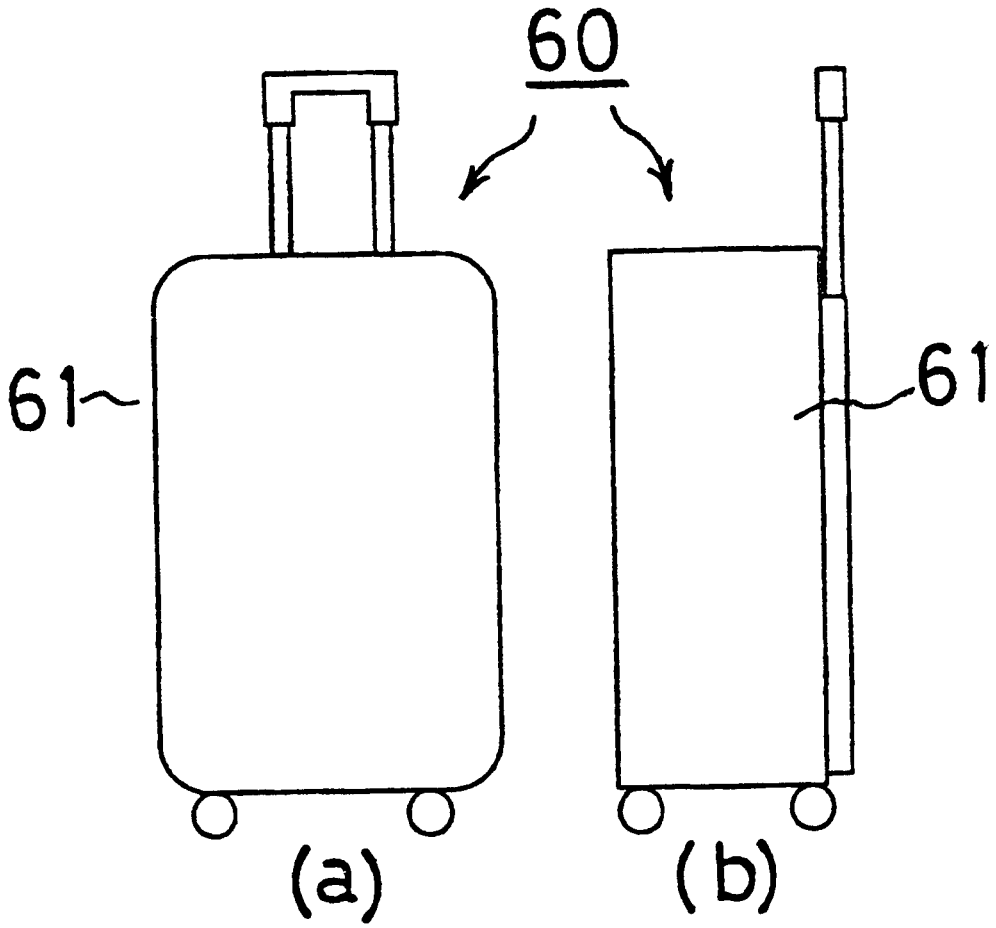
FIG. 9 PRIOR ART
FIGS. 9*a* and *b* shows a front view and a side view of the prior art luggage as shown in FIG. 7.

As shown in FIGS. 1 and 2, the luggage A comprises a frame B which is disposed between the outer cloth and the lining cloth to form a luggage main body C.

As shown in FIG. 2, the luggage is provided with a plurality of casters 11, and a handle 12 for holding and carrying the luggage.

The present invention is characterized by the frame B, which is made of a rigid plastic material and is formed of a bottom plate 1, a top side plate 2, and a back plate 3. The casters 11 are pivoted to the bottom plate 1. The top side plate 2, two side plates 2A, and a top plate 2B are connected with one another.

The bottom plate 1 has four raised side edges and a shape similar to that of a tray. The side edges are raised to enhance the structural strength of the bottom plate 1 and to facilitate the mounting of the frame B.

In addition, the front and the rear corners of the bottom plate 1 are arcuate in shape.

As shown in the drawings, the top side plate 2 has two shoulders which are of an arcuate construction.

As shown in FIG. 1 and FIG. 2*b*, the front edge line E of the side plate 2A and the corners have an arcuate design of esthetic effect.

The four front edge portions of the frame B are the front edge line E referred to above.

The top side plate 2 of the preferred embodiment of the present invention is provided in the inner side of a longitudinal side thereof with a reinforcing strap plate 4.

The top of the back plate 3 is provided with a stacking plate 3A which has a specific length and a specific width.

As shown in FIG. 2*b*, the juncture of the stacking plate 3A and the back plate 3 is of an arcuate construction.

As shown in FIG. 1, the stacking plate 3A is fastened with the top plate 2B by a plurality of fastening screws 5 or other appropriate fastening means.

The lower ends of the two side plates 2A and the back plate 3 are fastened respectively with the left side edge, the right side edge, and the rear edge portion of the bottom plate 1 by a plurality of fastening screws 5 or other appropriate fastening means. The bottom plate 1 serves as a support base.

As shown in FIG. 1, the opening of the front side of the frame B and the longitudinal box body are integral structure.

The left side edge and the right side edge of the back plate 3 are not connected with the side plates 2A, the resistance of the frame B to deformation is not adversely affected.

The assembly method of the luggage A is described hereinafter.

The luggage main body C is first formed by the outer cloth and the lining cloth which is joined with the outer cloth by sewing.

In light of the frame B having a strong resistance to deformation, the frame B is not provided with a reinforcing ring of a metal material for preventing the deformation.

The lining cloth is provided with a cut to facilitate the inserting of the frame B into the space located between the outer cloth and the lining cloth. This drawing is omitted.

The cut is provided with a zipper fastened thereto by sewing such that the cut can be opened or closed, and such that the inserted frame B can be fixed.

Upon completion of the assembly of the luggage main body C, the integrally-made frame B can be easily inserted into the space located between the outer cloth and the lining cloth.

Upon completion of the assembly of the frame B, the luggage A is provided with one or more casters 11 and the accessories.

The luggage of the present invention has advantages over the prior art luggages. The advantages of the present invention are described hereinafter.

The frame is made integrally to reinforce the luggage structure and is extremely resistant to deformation. The frames of the prior art luggages are formed of the component parts which are made separately and are then joined together.

In light of the frame being resistant to deformation, the luggage of the present invention is not provided with a reinforcing ring of metal and is therefore relatively light in weight and cost-effective. In addition, the process of inserting the frame into the space between the outer cloth and the lining cloth is relatively simple and fast.

The frame of the present invention is formed of a plurality of plates and can be easily provided with an arcuate profile by changing the shape of the plates. As a result, the luggage of the present invention has a beautiful profile.

The embodiment of the present invention described above is to be regarded in all respects as being merely illustrative and not restrictive. Accordingly, the present invention may be embodied in other specific forms without deviating from the spirit thereof. The present invention is therefore to be limited only by the scope of the following claims.

I claim:

1. An article of luggage comprising:

an outer cloth;

an inner cloth secured to said outer cloth; and a frame disposed between said outer cloth and said inner cloth, said frame having a bottom plate and a first top side plate and a second top side plate and a back plate and a first side plate and a second side plate and a top plate, said top plate being joined to said first and second top side plates, said first top side plate being joined to said first side plate, said second top side plate being joined to said second side plate, said bottom plate having a plurality of upwardly extending sides around a periphery thereof, said back plate being affixed to a first of said upwardly extending sides of said bottom plate, said first side plate being affixed to a second of said upwardly extending side of said bottom plate, said second side plate affixed to a third of said upwardly extending sides of said bottom plate, said back plate being affixed to said top plate, said back plate having a stacking plate at a top thereof.

2. The article of claim 1, said frame having a curved forward edge.

* * * * *